United States Patent [19]

Lipscombe

[11] Patent Number: 4,486,160

[45] Date of Patent: Dec. 4, 1984

[54] PUMPS AND MOTORS

[75] Inventor: Brian R. Lipscombe, Frome, England

[73] Assignee: Dowty Hydraulic Units Limited, England

[21] Appl. No.: 393,419

[22] Filed: Jun. 29, 1982

[30] Foreign Application Priority Data

Jul. 18, 1981 [GB] United Kingdom ..... 8122253

[51] Int. Cl.³ ..... F01C 1/18

[52] U.S. Cl. ..... 418/205; 418/206; 418/270

[58] Field of Search ..... 417/540, 542, 199; 418/150, 205, 206, 270

[56] References Cited

U.S. PATENT DOCUMENTS 3,785,758 1/1974 Adams ..... 418/150
4,079,865 3/1978 Kutik ..... 417/541

FOREIGN PATENT DOCUMENTS 248038 11/1924 United Kingdom .
509039 10/1938 United Kingdom .
609108 3/1946 United Kingdom .
1420422 12/1973 United Kingdom .

*Primary Examiner*—Leonard E. Smith
*Assistant Examiner*—Jane E. Obee
*Attorney, Agent, or Firm*—Hayes, Davis & Soloway

[57] ABSTRACT

A pump or motor comprising a casing, housing at least one rotary member and having an inlet port and an outlet port, cam means rotatable by said member and a fluid displacement device which is driven by the cam means and which includes at least one reciprocable element. This element, upon rotation of said member through each revolution, so repeatedly projects into a chamber in the casing which is in communication with one of said ports as to effect a series of momentary decreases in the effective volume of that chamber and the element is also so repeatedly retracted from that chamber as to effect a series of momentary increases in the effective volume of the chamber. In this way momentary flow of fluid is caused repeatedly to occur out from, and back into, the chamber thereby substantially reducing pulsation of flow through the pump or motor, and also attendant noise, during operation.

11 Claims, 2 Drawing Figures

PUMPS AND MOTORS

Figure 1:
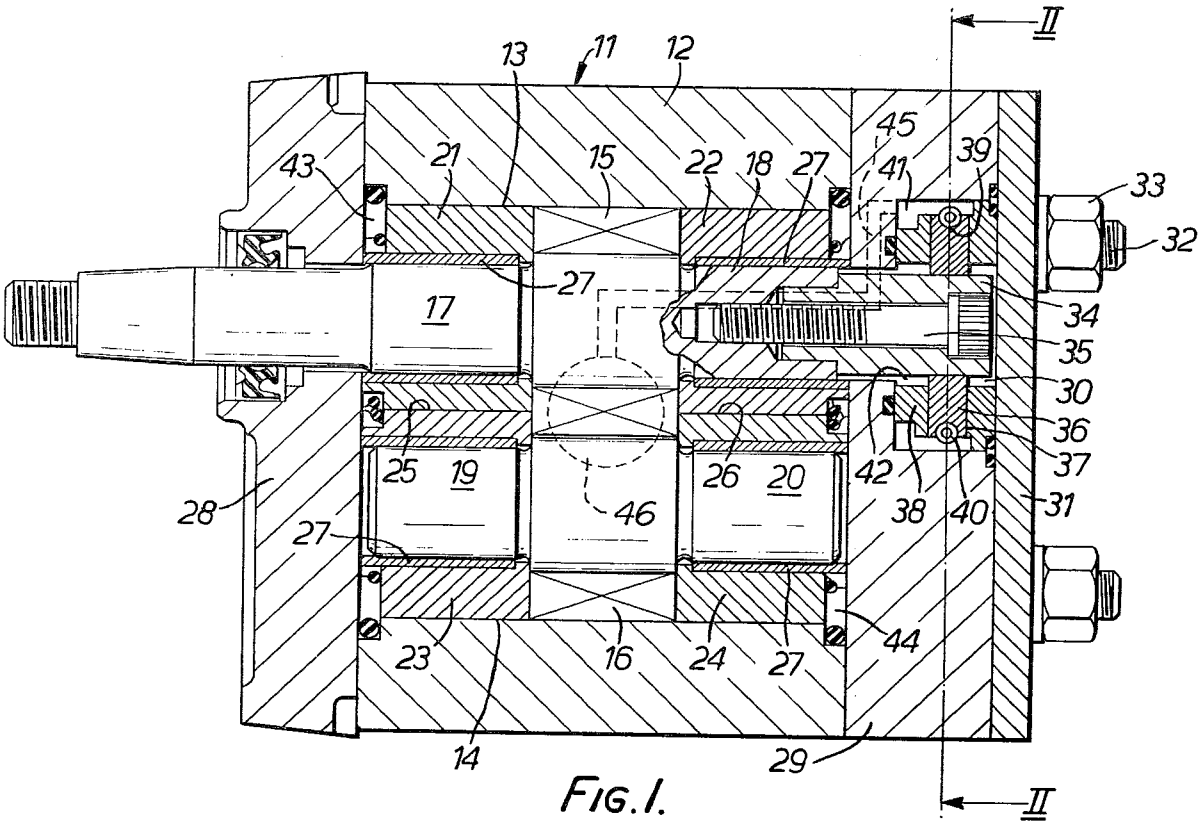

This invention relates to pumps and motors.

Hitherto in certain forms of pumps and motors, particularly those of gear type, it has been found that during operation thereof pulsation, or "ripple", in fluid flow has occurred. In gear pumps or motors for example the extent of such pulsation is dependent upon the shapes of the teeth of the gears, the number of teeth and the positions of the contact points on the flanks of the intermeshing teeth. Here ideally there should be no variation in flow with gear rotation at any designed operating speed, but in practice the actual operating characteristics produced have, graphically, for each gear revolution included a series of peaks and a series of troughs with such consequent flow pulsation that the pumps and motors have proved to be unacceptable for certain applications due to the noise level reached during operation.

In an endeavour to reduce noise, for example in gear pumps and motors, it has already been arranged for the gears thereof to have relatively large numbers of teeth. In order to reduce noise further gear pumps and motors of dual type have been produced in which one pair of gears have their teeth meshing one half tooth pitch out-of-phase with respect to a second pair of gears arranged in parallel with the first pair, and smoother operating characteristics have been achieved. However the results have still left much to be desired from the noise standpoint.

The invention as claimed is intended to provide a remedy. It solves the problem of how to design a pump or motor in which means are provided for at least substantially reducing the said peaks and for at least substantially removing the said troughs in the operating characteristics of the pump or motor thereby substantially to reduce pulsation of flow and attendant noise during operation.

According to the invention a pump or motor comprises a casing, which houses at least one rotary member and which has an inlet port and an outlet port, cam means connected to be rotated by said member and a fluid displacement device which is driven by said cam means when rotating and which includes at least one reciprocable element which, upon rotation of said rotary member through said revolution, so repeatedly projects into a chamber in said casing which is in communication with one of said ports as to effect a series of momentary decreases in the effective volume of that chamber and which is so repeatedly retracted from that chamber as to effect a series of momentary increases in the effective volume of said chamber thereby to cause momentary flow of fluid repeatedly to occur out from, and back into, said chamber.

Each momentary flow of fluid out from said chamber, which is towards at least one of said ports, has the effect of at least substantially removing a trough otherwise in the operating characteristics of the pump or motor and each momentary flow of fluid back into said chamber has the effect of at least substantially reducing a peak otherwise in said characteristics. As a result pulsation of flow through the pump or motor is reduced.

The pump or motor may be of gear type in which case at least two of said rotary members may be provided which are in the form of intermeshing gears. Here said cam means preferably has the same number of lobes as there are teeth on each gear and thus each projection of said element into said chamber coincides with a respective trough in said characteristics and each retraction of said element from said chamber coincides with a respective peak in said characteristics.

The advantages offered by the invention are mainly that as a result of the reduced pulsation of flow through the pump or motor, the pump or motor operates at a much lower noise level and, since in consequence wear of the components thereof is reduced, it has a longer life.

Figure 2:
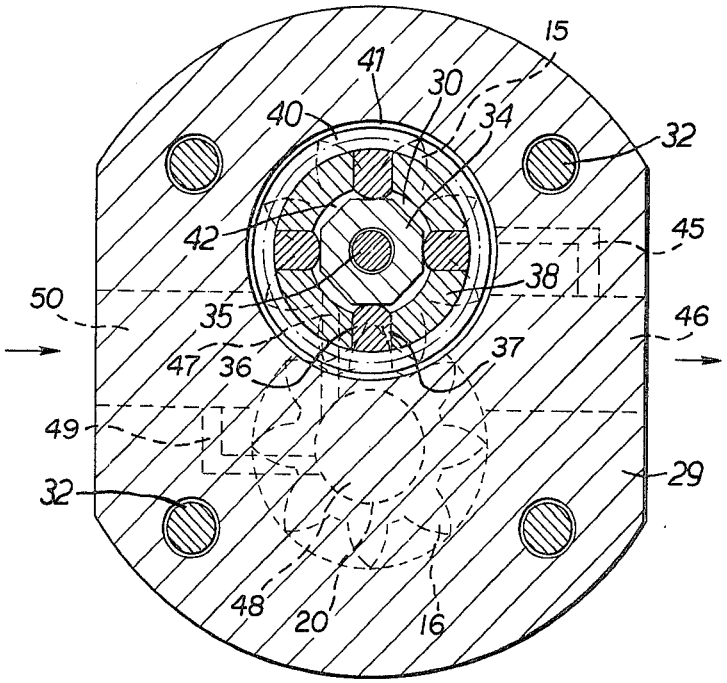

One way of carrying out the invention is described in detail below with reference to the accompanying drawings which illustrate only one specific embodiment, in which:

FIG. 1 is a cross-sectional elevation of a gear pump in accordance with the invention, and, FIG. 2 is a cross-section taken along the line II—II in FIG. 1.

The gear pump 11 shown includes a main casing 12 having overlapping bores 13, 14 which in conventional manner house a pair of rotary members in the form of intermeshing gears 15, 16, the shafts 17, 18, 19, 20 of which are supported for rotation in bushes 21, 22, 23, 24 respectively of D-shaped cross-section. The flats of the bushes interengage as shown at 25 and 26 and each bush is provided with a liner 27 of suitable long-wearing material.

The shaft 17, which forms the driving shaft of the pump, extends to the exterior of the pump through an end cover member 28 suitably secured to the left-hand face in FIG. 1 of the main casing 12.

A subsidiary casing 29 having a cavity 30 of circular cross-section formed therein is secured to the right-hand face in FIG. 1 of the main casing 12, and a cover plate 31 is secured to the right-hand face of the subsidiary casing.

In this embodiment the casing 12, cover member 28, casing 29 and cover plate 31 are held in unit assembly by a plurality of bolts, as at 32, which pass through them all, and by nuts as at 33, applied to the bolts.

Cam means in the form of a member 34 of octagonal cross-section at its right hand-end portion in FIG. 1 is secured in coaxial manner to the shaft 18, so as to be rotatable therewith, by a bolt 35 suitably provided with locking means (not shown). The member 34 projects into the cavity 30 and its octagonal end portion is engaged by four reciprocable elements 36 which are radially slidable in respective bores 37 provided in an annular insert 38 suitably non-rotatably located in the cavity 30 coaxially with respect to the shaft 18 and member 34. The elements 36 and the insert 38 form a fluid displacement device.

The bores 37 and thus the elements 36 are equispaced circumferentially of the insert 38. The end portions of the elements 36 which engage the octagonal cam formation of the member 34 are of semi-circular cross-section as shown in FIG. 2 and the outer end portion of each of these elements has a groove 39 also of semi-circular cross-section. An endless spring ring 40 surrounds the insert 38 and seats in the grooves 39 thus to bias the elements 36 into engagement with the cam formation of the member 34.

The annular portion 41 of the cavity 30 surrounding the insert 38 forms a chamber which is in communication by way of a passage 45 in the pump casing structure with the outlet or delivery port 46 of the pump.

The annular clearance 42 between the member 34 and the insert 38 is open through a passage 47 to a low pressure region 48 of the pump which in turn is in communication through a passage 49 with the inlet port 50 of the pump.

Pressure-balancing means of known form are embodied in the pump and are generally indicated at 43 and 44 in FIG. 1.

In this embodiment the gears each have eight teeth.

During operation of the gear pump 11 the shaft 17 is driven by suitable means (not shown), for example an electric motor, and liquid is drawn in through the inlet port 50 and is elevated in pressure by the action of the rotating intermeshing gears 15, 16. Liquid under high pressure is discharged from the delivery port 46 to a point of usage, and during operation the pressure-balancing means 43 and 44 hold the bushes 21, 22, 23, 24 in adequate sealing contact with the faces of the gears, the bushes being thereby so hydraulically balanced that undue wear thereof is avoided.

During pumping operation, since the member 34 is being driven from the shaft 18 of gear 15 the four elements 36 are reciprocating in their bores 37. Since the cam formation of the member 34 has eight lobes, each of the elements is reciprocated in its bore eight times for each revolution of the shaft 18 and gear 15. Thus the elements all move outwardly simultaneously against the spring ring 40 thereby projecting into the annular portion or chamber 41 of the cavity 30 and then move back into their bores to the positions shown in the drawings in which their radially-outer end faces are flush with the exterior surface of the insert 38. In simultaneously moving in the radially-outward direction from a mean stroke position these elements together effect such momentary decrease in effective volume of the annular chamber as to cause a momentary flow of fluid from the chamber into the delivery port 46 of the pump to occur thereby increasing overall flow. Such momentary flow in this direction occurs eight times per revolution of the gears.

Further, the elements 36, in moving also, and simultaneously, in the radially-inward direction from the mean stroke position to the position in which their radially-outer end faces are each flush with the exterior surface of the insert 38, together effect such momentary increase in effective volume of the annular chamber 41 that a momentary flow of fluid from the delivery port 46 into the chamber occurs thereby reducing overall flow. Such momentary flow in this direction also occurs eight times per revolution of the gears.

Considering conventional gear pump operation, that is operation of a gear pump without a cam member 34 and without elements 36, the delivery flow characteristics are such, evident when graphically plotted against gear rotation, that a pulsating or "ripple" effect is produced due to the occurrence of a series of flow peaks and a series of flow troughs in the resultant performance curve. These peaks and troughs result from the successive meshing and unmeshing of the co-operating teeth of the gears, and with eight teeth on each gear a series of eight peaks and a series of eight troughs are graphically evident for each revolution of the gears.

It has been proven in practice that the pulsating or ripple effect produced by such peaks and troughs causes the pump to be noisy in operation.

However, as explained above, the cam member 34 and elements 36 included in the construction of the present invention provides means for momentarily increasing the flow of liquid passing into the delivery port 46 and for momentarily decreasing the flow of liquid passing into the delivery port, in this embodiment each eight times during one revolution of the gears. The cam means is so arranged that such momentary increases are caused to occur at the eight positions in the one revolution cycle at which the said troughs would otherwise occur, and such momentary decreases are caused to occur at the eight positions in the one revolution cycle at which the said peaks would otherwise occur. Since these momentary increases and decreases in flow, within the pump, into the delivery port 46 have the effect of avoiding, to a substantial extent at least, the setting up of such peaks and troughs, the pulsating or ripple effect in the pump delivery flow is substantially reduced and a significant reduction in operational noise level of the pump is obtained.

During operation of the pump the elements 36 when reciprocating also simultaneously project radially-inwardly into, and move radially-outwardly from, the annular clearance 42 which is in communication with inlet port 50. The flow characteristics, which to a certain extent reflect those on the delivery side of the pump, are therefore modified in a manner likewise to that on the high pressure side and this contributes to the reduction in operational noise level of the pump.

Although in the embodiment above-described with reference to the drawings the four said elements 36 are provided in association with the cam member 34, in other embodiments any other suitable number of elements may instead be provided. Further, the invention is not limited to the gears each having eight teeth as in other embodiments they are provided with any other suitable number of teeth provided the cam member has a similar number of lobes whereby the said momentary flows of fluid into, and from, the delivery port 46 respectively coincide with the said troughs and peaks during pump operation.

The invention is not limited to the said elements being radially-disposed, as in other embodiments they may be axially disposed and in this case the cam means be suitably designed to co-operate therewith.

Again, although in the embodiment above-described with reference to the drawings the invention is applied to a gear pump, in alternative embodiments the invention may with advantage be applied to gear motors.

Finally, although in the embodiment above-described with reference to the drawings the invention is applied to a pump of gear type, in alternative embodiments the invention may with advantage be applied to pumps, and also motors, of other type, for example of axial-piston type, where flow pulsation problems with attendant noise in operation otherwise occur.

What is claimed is:

1. A pump or motor comprising a casing, which houses at least one rotary member and which has an inlet port and an outlet port, cam means connected to be rotated by said member and a fluid displacement device which is driven by said cam means when rotating and which includes at least one reciprocable element which, upon rotation of said rotary member through each revolution, so repeatedly projects into a chamber in said casing which is in communication with one of said ports as to effect a series of momentary decreases in the effective volume of that chamber and which is so repeatedly retracted from that chamber as to effect a series of momentary increases in the effective volume of said chamber thereby to cause momentary flow of fluid repeatedly to occur out from, and back into, said chamber.

2. A pump or motor as claimed in claim 1, wherein said chamber is in communication with that one of said inlet port and said outlet port which is at high pressure.

3. A pump or motor as claimed in claim 1 and of gear type, wherein at least two of said rotary members are provided and are in the form of intermeshing gears.

4. A pump or motor as claimed in claim 3, wherein said cam means has the same number of lobes as there are teeth on each gear.

5. A pump or motor as claimed in claim 1, wherein said chamber is formed by the annular outer portion of a cavity of circular cross-section formed in the casing.

6. A pump or motor as claimed in claim 5, wherein an annular insert, surrounded by said chamber, is non-rotatably located in said cavity and said cam means is disposed in the central opening of said insert.

7. A pump or motor as claimed in claim 6, wherein a generally annular clearance is formed between said cam means and said insert, said clearance being in communication with that one of said inlet port and said outlet port which is at low pressure.

8. A pump or motor as claimed in claim 6, wherein each said reciprocable element is radially slidable in a respective bore formed in said insert and the inner end portion of each said element is directly engaged by said cam means.

9. A pump or motor as claimed in claim 8, wherein said inner end portion of each said element is of semi-circular cross-section.

10. A pump or motor as claimed in claim 8, wherein the outer end portion of each said element is provided with a groove of semi-circular cross-section.

11. A pump or motor as claimed in claim 8, wherein a spring ring surrounds said insert and seats in said groove of semi-circular cross-section.

* * * * *